US012808605B2

(12) United States Patent
Jiang et al.

(10) Patent No.: US 12,808,605 B2
(45) Date of Patent: Nov. 24, 2026

(54) HEAT EXCHANGER AND METHOD FOR MAKING THE SAME

(71) Applicant: HANGZHOU SANHUA RESEARCH INSTITUTE CO., LTD., Hangzhou City (CN)

(72) Inventors: Haobo Jiang, Coconut Creek, FL (US); Lizhi Wang, Hangzhou City (CN); Keke Xu, Hangzhou City (CN)

(73) Assignee: HANGZHOU SANHUA RESEARCH INSTITUTE CO., LTD., Hangzhou City (CN)

( * ) Notice: Subject to any disclaimer, the term of this patent is extended or adjusted under 35 U.S.C. 154(b) by 929 days.

(21) Appl. No.: 17/964,014

(22) Filed: Oct. 11, 2022

(65) Prior Publication Data

US 2023/0111700 A1 Apr. 13, 2023

(30) Foreign Application Priority Data

Oct. 11, 2021 (CN) ..... 202111182245.7

(51) Int. Cl.
*F28D 7/16* (2006.01)

(52) U.S. Cl.
CPC ..... *F28D 7/16* (2013.01)

(58) Field of Classification Search
CPC ..... F28D 1/05383; F28D 7/16; F28F 9/0243; F28F 9/0246; F28F 9/027; F28F 9/0273; F28F 2220/00
See application file for complete search history.

(56) References Cited

U.S. PATENT DOCUMENTS

| | | | | |
|---|---|---|---|---|
| 9,459,057 | B2 * | 10/2016 | Wand | F28F 9/02 |
| 10,551,099 | B2 * | 2/2020 | Pautler | F28F 1/126 |
| 2009/0173482 | A1 * | 7/2009 | Beamer | F28D 1/05383 165/173 |
| 2011/0240276 | A1 * | 10/2011 | Wintersteen | F28D 1/05383 165/173 |

FOREIGN PATENT DOCUMENTS

| | | | | |
|---|---|---|---|---|
| FR | 3059396 | A1 * | 6/2018 | F28F 9/0268 |
| FR | 3059404 | A1 * | 6/2018 | F28F 9/0273 |
| FR | 3075346 | A1 * | 6/2019 | F28F 9/0273 |
| FR | 3075349 | A1 * | 6/2019 | F28F 9/0273 |
| FR | 3097956 | A1 * | 1/2021 | F28F 27/02 |
| WO | WO-2020063226 | A1 * | 4/2020 | F28F 9/0273 |

OTHER PUBLICATIONS

English translation FR 3075346A1 (Year: 2019).*

* cited by examiner

*Primary Examiner* — Tho V Duong
(74) *Attorney, Agent, or Firm* — Cheng-Ju Chiang

(57) ABSTRACT

A heat exchanger includes a collecting pipe, a number of heat exchange tubes and a distributor. The collecting pipe has a first cavity and a first inner peripheral wall. The heat exchange tube has a second cavity. The distributor is accommodated in the first cavity. The distributor has a main cavity and a flow channel. The distributor includes a second inner peripheral wall forming the main cavity and a first outer peripheral wall. An axis of the first outer circle is not coaxial with an axis of the second outer circle, so that the flow channel of the distributor is relatively tortuous. It is beneficial to improve the distribution effect of a fluid. Besides, since the flow channel is formed inside the distributor, it is also beneficial to reduce the manufacturing difficulty of the distributor. A method for making the heat exchanger is also disclosed.

20 Claims, 15 Drawing Sheets

HEAT EXCHANGER AND METHOD FOR MAKING THE SAME

CROSS-REFERENCE TO RELATED APPLICATION

This patent application claims priority of a Chinese Patent Application No. 202111182245.7, filed on Oct. 11, 2021 and titled "HEAT EXCHANGER", the entire content of which is incorporated herein by reference.

TECHNICAL FIELD

The present disclosure relates to a technical field of exchanging heat, in particular to a heat exchanger and a method for making the same.

BACKGROUND

The related art provides a heat exchanger including an inlet collecting pipe and a distributor. The distributor is received in the inlet collecting pipe. An outer wall surface of the distributor and an inner pipe wall of the inlet collecting pipe are matched to form a gap through which a refrigerant can pass. In this way, the distribution effect of the gas-liquid refrigerant can be optimized through the cooperation of the inlet collecting pipe and the distributor.

However, in the above-mentioned technology, the formation of the gap depends on the respective machining accuracy and fitting accuracy between the distributor and the inlet collecting pipe, thereby increasing the manufacturing difficulty of the heat exchanger.

SUMMARY

An object of the present disclosure is to provide a heat exchanger with lower manufacturing difficulty and a method for making the same.

In order to achieve the above object, the present disclosure adopts the following technical solution: a heat exchanger, including: a collecting pipe having a first cavity and a first inner peripheral wall forming the first cavity; a plurality of heat exchange tubes disposed along a length direction of the collecting pipe, each heat exchange tube having a second cavity, the first cavity communicating with the second cavities of the plurality of heat exchange tubes; and a distributor at least partially located in the first cavity, the distributor having a main cavity and a flow channel, the distributor including a second inner peripheral wall forming the main cavity and a first outer peripheral wall facing the first inner peripheral wall; wherein the flow channel is formed with a first port at the second inner peripheral wall and a second port at the first outer peripheral wall, the first port communicates with the main cavity, the second port communicates with the first cavity, a smallest circle around the first port is defined as a first outer circle, a smallest circle around the second port is defined as a second outer circle, and an axis of the first outer circle is not coaxial with an axis of the second outer circle.

In order to achieve the above object, the present disclosure adopts the following technical solution: a heat exchanger, including: a collecting pipe including a first inner peripheral wall and a first cavity formed by the first inner peripheral wall; a plurality of heat exchange tubes, each heat exchange tube defining a second cavity communicating with the first cavity; and a distributor at least partially located in the first cavity, the distributor including a second inner peripheral wall, a main cavity formed by the second inner peripheral wall, a flow channel, and a first outer peripheral wall facing the first inner peripheral wall; wherein the flow channel is formed with a first port at the second inner peripheral wall and a second port at the first outer peripheral wall, the first port communicates with the main cavity, the second port communicates with the first cavity, an axis of the first port and an axis of the second port are not coaxial with each other.

In order to achieve the above object, the present disclosure adopts the following technical solution: a method for making a distributor which is applied in a heat exchanger, the heat exchanger including: a collecting pipe having a first cavity and a first inner peripheral wall forming the first cavity; a plurality of heat exchange tubes, each heat exchange tube having a second cavity, the first cavity communicating with the second cavities of the plurality of heat exchange tubes; and the distributor at least partially located in the first cavity, the distributor having a main cavity and a flow channel, the distributor including a second inner peripheral wall forming the main cavity and a first outer peripheral wall facing the first inner peripheral wall; wherein the flow channel is formed with a first port at the second inner peripheral wall and a second port at the first outer peripheral wall, the first port communicates with the main cavity, the second port communicates with the first cavity, a smallest circle around the first port is defined as a first outer circle, a smallest circle around the second port is defined as a second outer circle, and an axis of the first outer circle is not coaxial with an axis of the second outer circle; the method for making the distributor including following steps: step S1: processing to make a blank piece; step S2: drilling a hole between the first outer peripheral wall and the second inner peripheral wall to form the first passage and a machining hole; and step S3: blocking the machining hole.

The present disclosure provides the heat exchanger of which the distributor has the main cavity and the flow channel. The flow channel is formed with the first port at the second inner peripheral wall, and the second port formed at the outer peripheral wall. Since the axis of the first outer circle is not coaxial with the axis of the second outer circle, the flow channel of the distributor is relatively tortuous, which is beneficial to improve the distribution effect of a fluid. Besides, since the flow channel is formed inside the distributor, the assembly is simpler and the manufacturing difficulty of the heat exchanger is simplified.

DETAILED DESCRIPTION

Figure 1:
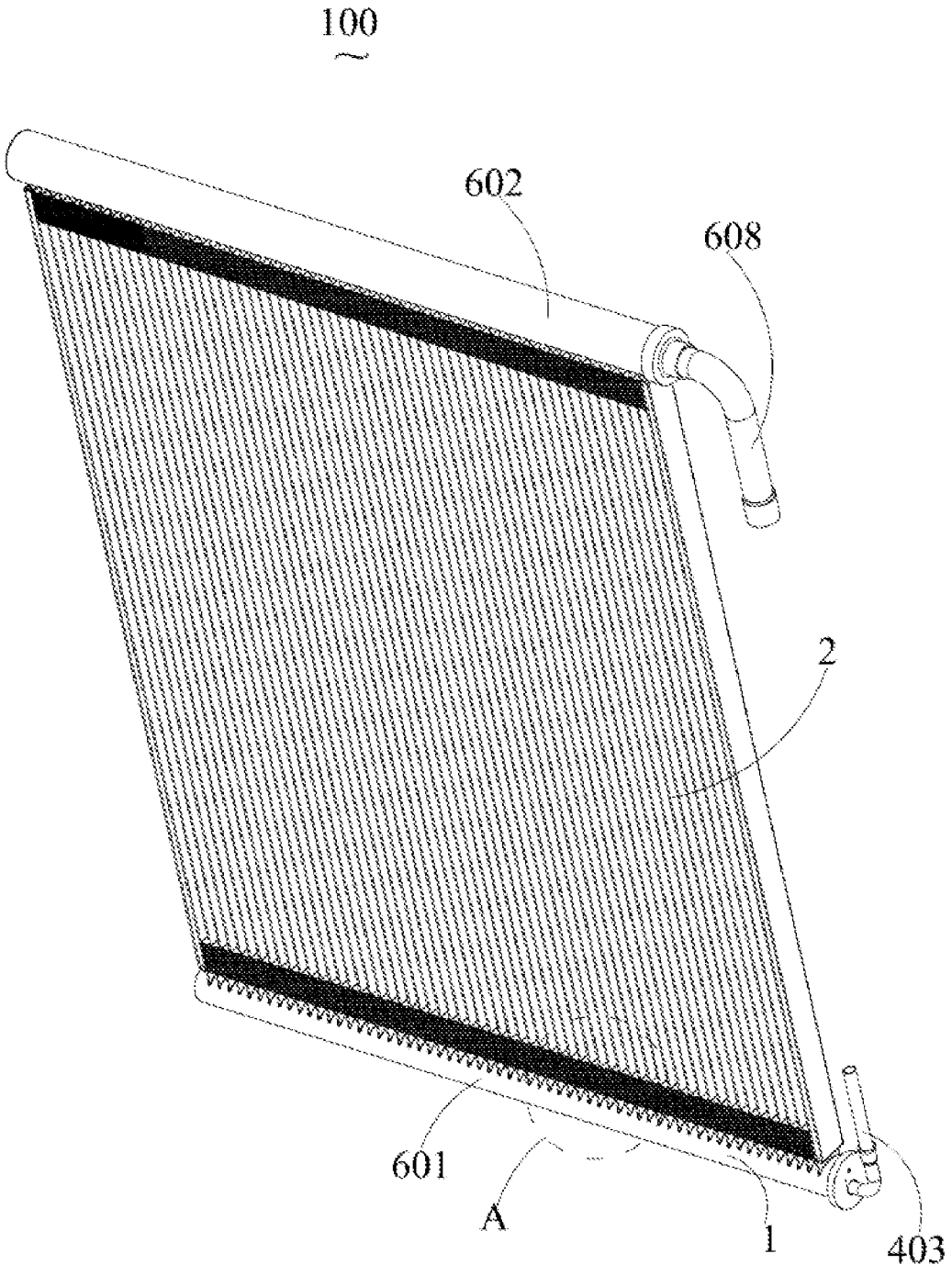
FIG. 1 is a schematic perspective structural view of a heat exchanger in accordance with an embodiment of the present disclosure.
Figure 2:
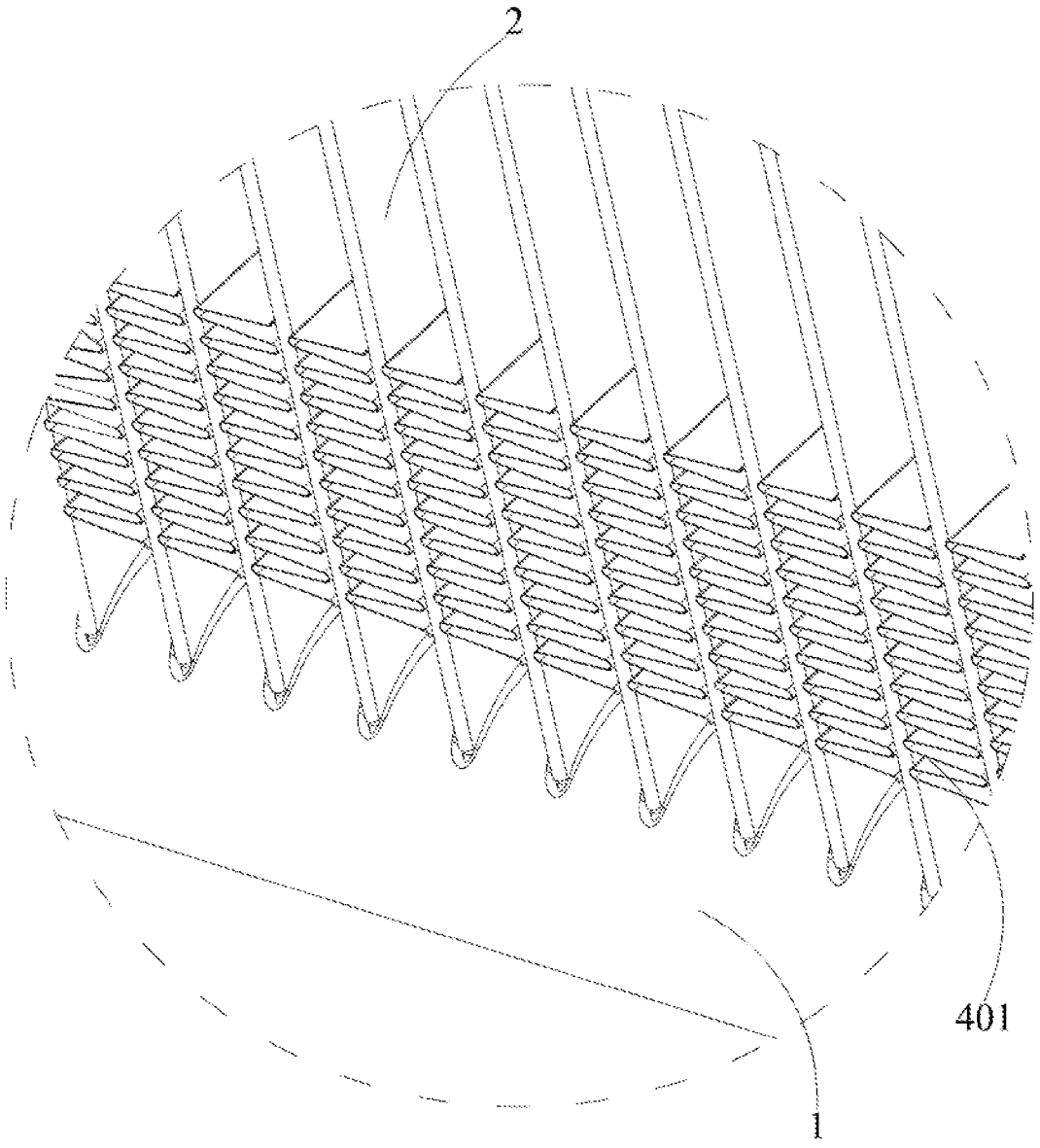
FIG. 2 is an enlarged view of portion A in FIG. 1.
Figure 3:
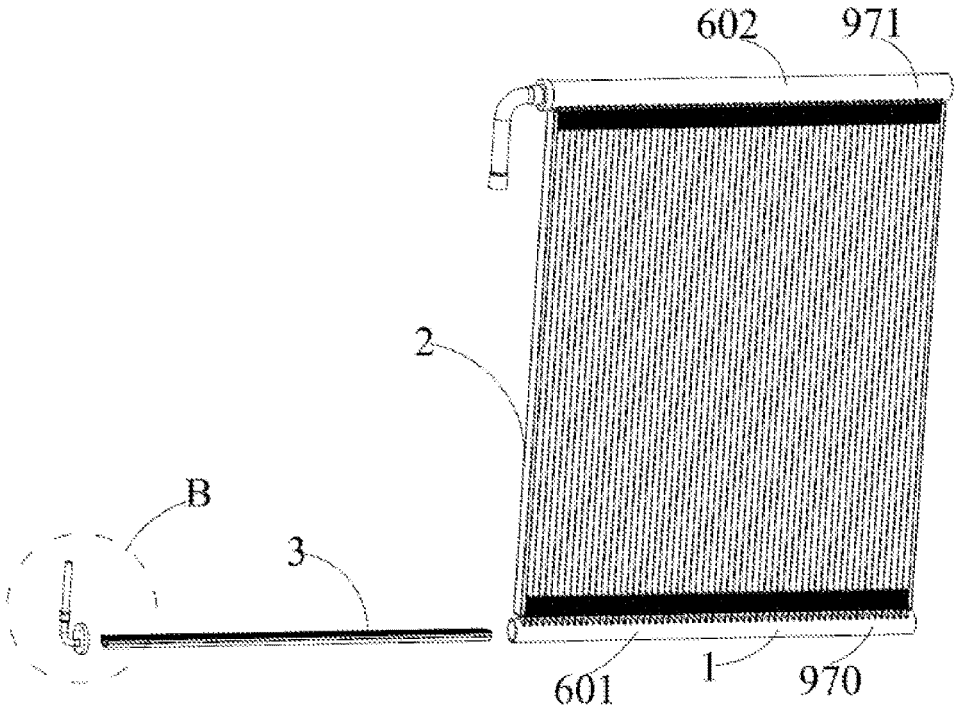
FIG. 3 is a schematic exploded structural view of the heat exchanger in accordance with the embodiment of the present disclosure.
Figure 4:
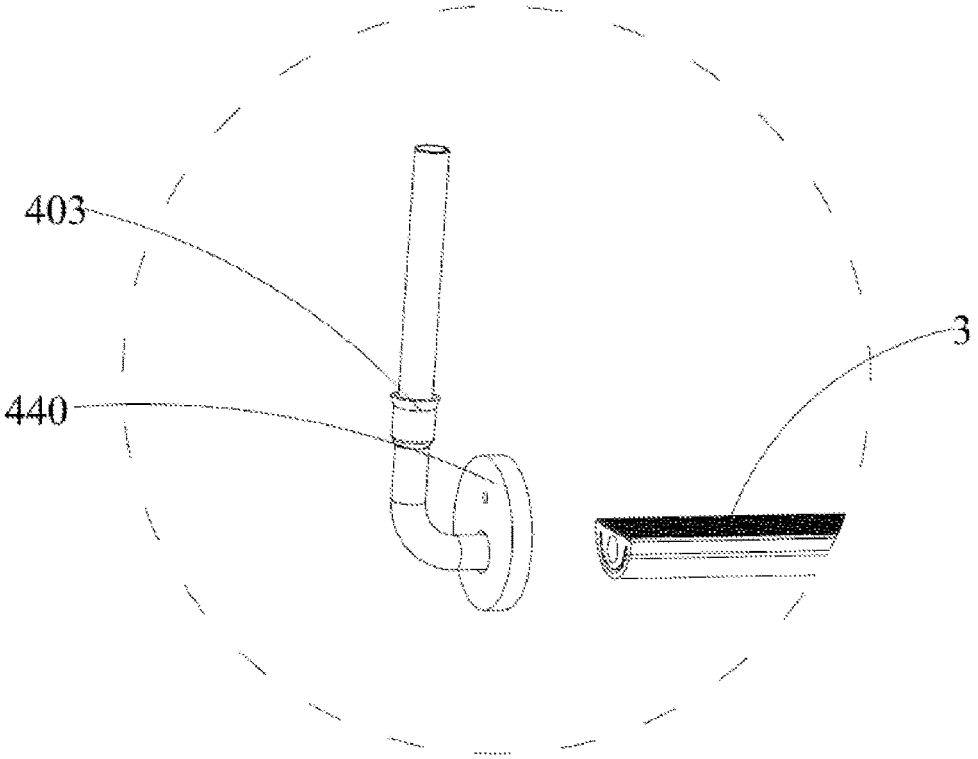
FIG. 4 is an enlarged view at portion B in FIG. 3.
Figure 5:
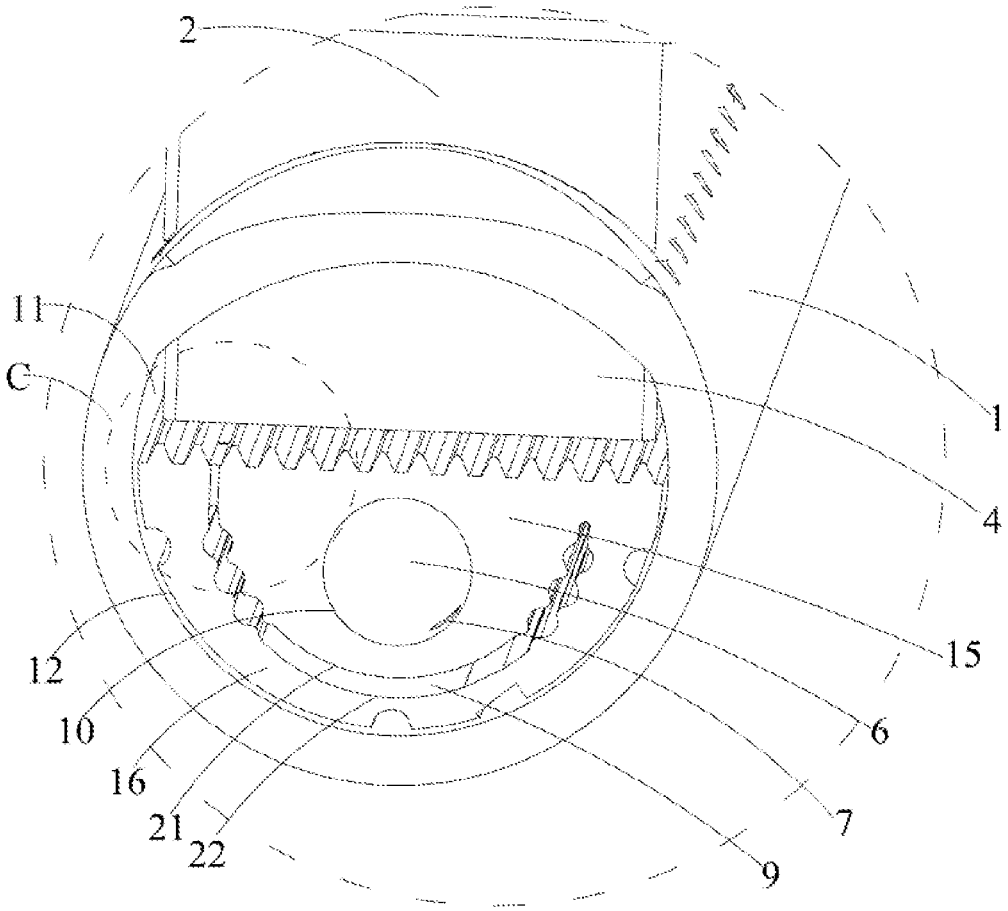
FIG. 5 is a schematic assembled structural view of a distributor and a collecting pipe in accordance with the embodiment of the present disclosure.

Exemplary embodiments will be described in detail here, examples of which are shown in drawings. When referring to the drawings below, unless otherwise indicated, same numerals in different drawings represent the same or similar elements. The examples described in the following exemplary embodiments do not represent all embodiments consistent with this application. Rather, they are merely examples of devices and methods consistent with some aspects of the application as detailed in the appended claims.

The terminology used in this application is only for the purpose of describing particular embodiments, and is not intended to limit this application. The singular forms "a", "said", and "the" used in this application and the appended claims are also intended to include plural forms unless the context clearly indicates other meanings.

It should be understood that the terms "first", "second" and similar words used in the specification and claims of this application do not represent any order, quantity or importance, but are only used to distinguish different components. Similarly, "an" or "a" and other similar words do not mean a quantity limit, but mean that there is at least one; "multiple" or "a plurality of" means two or more than two. Unless otherwise noted, "front", "rear", "lower" and/or "upper" and similar words are for ease of description only and are not limited to one location or one spatial orientation. Similar words such as "include" or "comprise" mean that elements or objects appear before "include" or "comprise" cover elements or objects listed after "include" or "comprise" and their equivalents, and do not exclude other elements or objects. The term "a plurality of" mentioned in the present disclosure includes two or more.

Hereinafter, some embodiments of the present disclosure will be described in detail with reference to the accompanying drawings. In the case of no conflict, the following embodiments and features in the embodiments can be combined with each other.

As shown in FIG. 1 to FIG. 12, a heat exchanger 100 provided in an embodiment of the present disclosure includes a collecting pipe 1, a plurality of fins 401, a plurality of heat exchange tubes 2, an inlet pipe 403, an outlet pipe 608, a distributor 3 and an end cap 440.

The collecting pipe 1 includes a first collecting pipe 601 and a second collecting pipe 602. The first collecting pipe 601 communicates with the inlet pipe 403. The second collecting pipe 602 communicates with the outlet pipe 608. The plurality of heat exchange tubes 2 are arranged along a length direction of the first collecting pipe 601. The first collecting pipe 601 has the first cavity 4. The first collecting pipe 601 includes a first inner peripheral wall 11 forming the first cavity 4. The heat exchange tube 2 has a second cavity 977. The first cavity 4 communicates with the second cavity 977. Each fin 401 is located between two adjacent heat exchange tubes 2. Each fin 401 is located between a second outer peripheral wall 970 of the first collecting pipe 601 and a third outer peripheral wall 971 of the second collecting pipe 602 in a thickness direction of the heat exchange tube 2. One end of each heat exchange tube 2 is located in the first cavity 4 of the first collecting pipe 601. The second collecting pipe 602 has a third cavity 978. The other end of each heat exchange tube 2 is located in the third cavity 978 of the second collecting pipe 602.

The second cavity 977, the first cavity 4 of the first collecting pipe 601, and the third cavity 978 of the second collecting pipe 602 are communicated. The outlet pipe 608 and the second collecting pipe 602 are fixed to each other, for example by welding. An inner cavity of the outlet pipe 608 communicates with the third cavity 978 of the second collecting pipe 602. The inlet pipe 403 extends through the end cap 440 in a thickness direction of the end cap 440. The end cap 440 and the inlet pipe 403 are in a sealing fit by welding. An outer peripheral wall of the end cap 440 and an inner wall of the first collecting pipe 601 forming the first cavity 4 are in a sealing fit by welding. An inner cavity of the inlet pipe 403 communicates with a main cavity 6. The distributor 3 is located in the first cavity 4. The distributor 3 has the main cavity 6 and a flow channel 9. The distributor 3 includes a second inner peripheral wall 10 forming the main cavity 6 and a first outer peripheral wall 12 facing the first inner peripheral wall 11. The main cavity 6 is configured for a fluid, such as a refrigerant, to flow.

Figure 7:
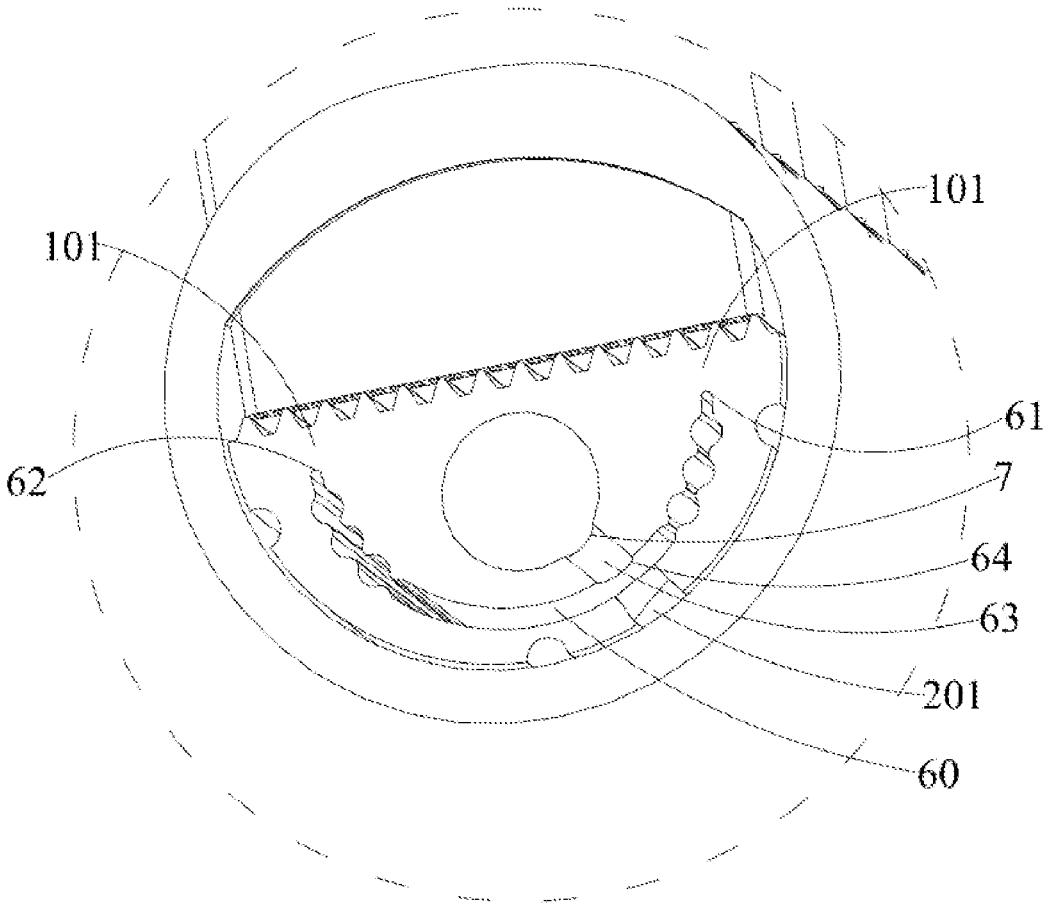
FIG. 7 is another schematic assembled structural view of the distributor and the collecting pipe in accordance with the embodiment of the present disclosure.
Figure 8:
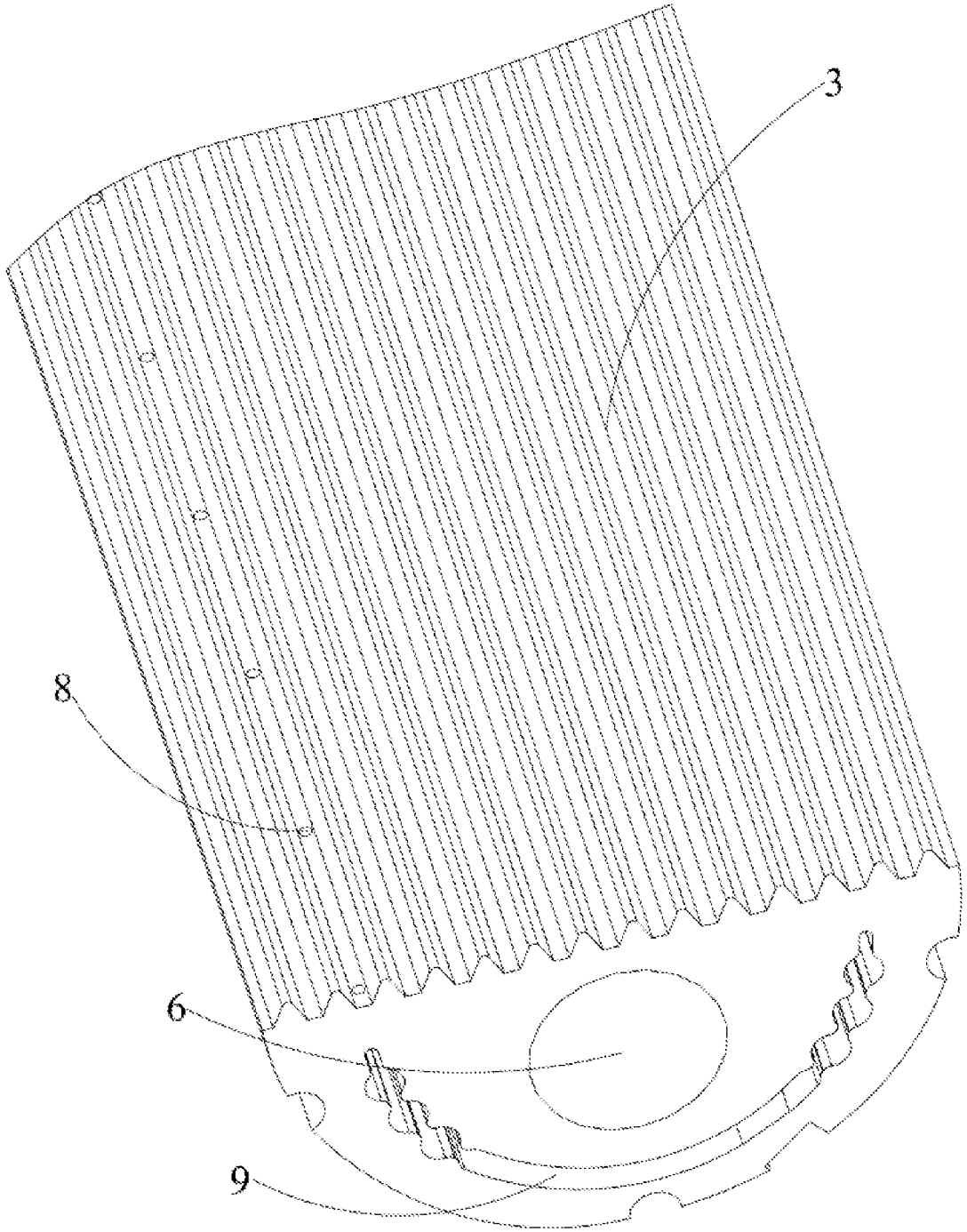
FIG. 8 is a schematic structural view of the distributor in accordance with an embodiment of the present disclosure.
Figure 13:
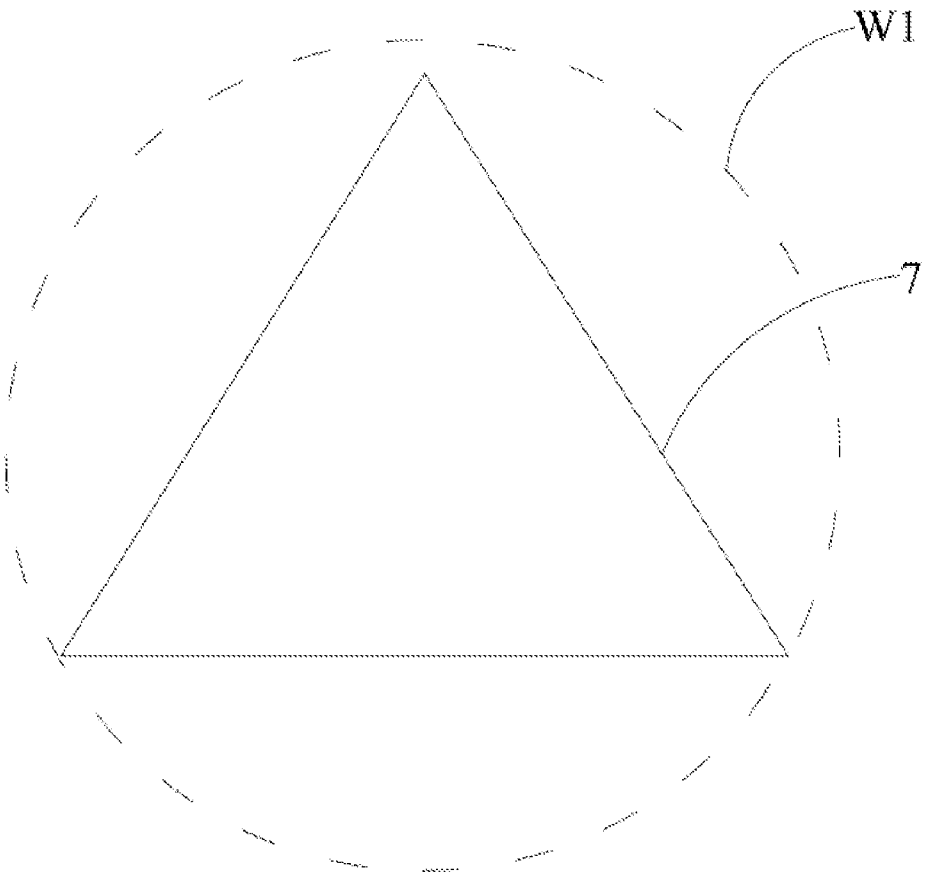
FIG. 13 is a schematic projection view of a first port and an imaginary first outer circle in another embodiment of the present disclosure.
Figure 14:
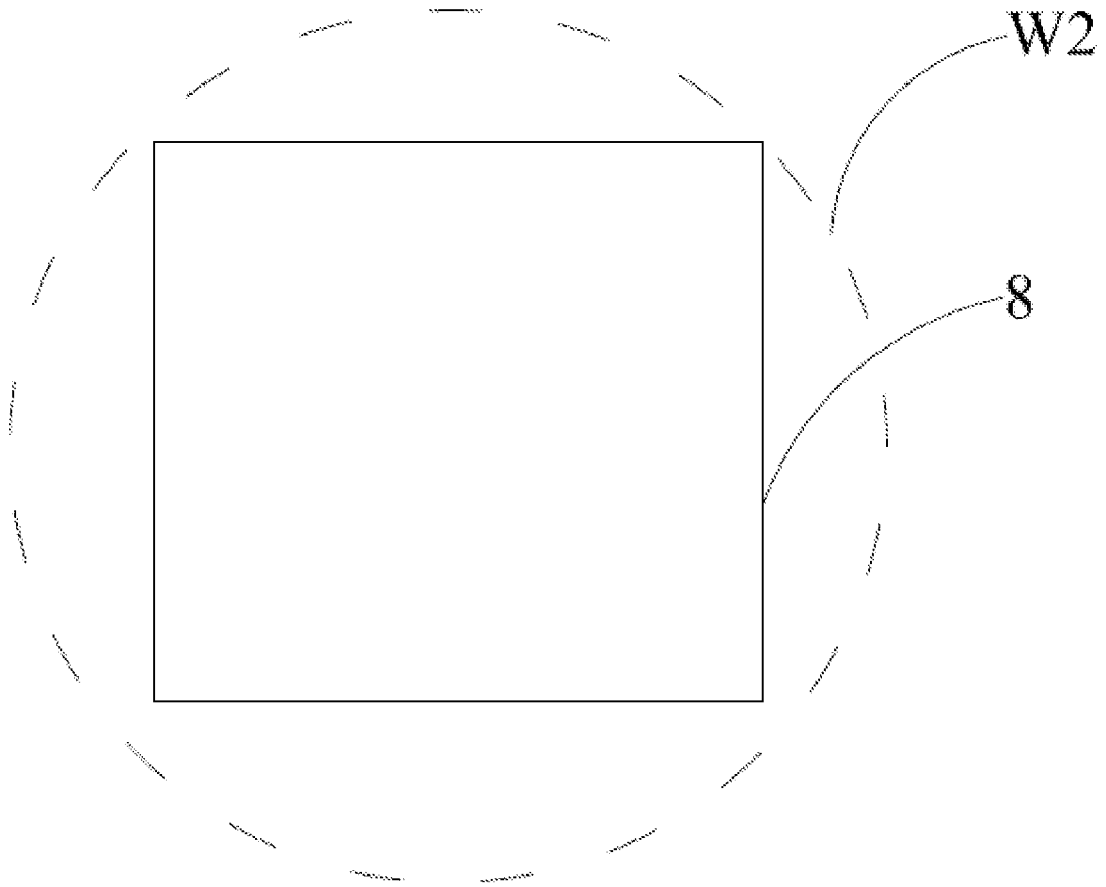
FIG. 14 is a schematic projection view of a second port and an imaginary second outer circle in another embodiment of the present disclosure.

The flow channel 9 is formed with a second port 8 at the first peripheral wall 12. The flow channel 9 has a first port 7 formed at the second inner peripheral wall 10. The first port 7 communicates with the main cavity 6. The second port 8 communicates with the first cavity 4. A smallest circle surrounding the first port 7 is defined as a first outer circle W1, a smallest circle surrounding the second port 8 is defined as a second outer circle W2, and an axis of the first outer circle W1 and an axis of the second outer circle W2 are not coaxial. As shown in FIG. 13 and FIG. 14, alternatively, the first port 7 and the second port 8 may not be standard circular, but may be rectangular or triangular. As shown in FIG. 7 and FIG. 8, when the first port 7 and the second port 8 are standard circles, the first port 7 and the first outer circle W1 are coincident, and the second port 8 and the second outer circle W2 are coincident. The first port 7 allows the refrigerant to flow into the flow channel 9 from the main cavity 6 through the first port 7. The flow channel 9 can be a narrow and long flow channel, which is beneficial to improve the mixing effect of the gas-liquid two-phase refrigerant. The second port 8 can allow the refrigerant to flow out from the flow channel 9 to the first cavity 4, and then the refrigerant flows into the heat exchange tube 2 from the first cavity 4. Setting the first port 7 and the second port 8 to be non-axial can make the flow channel 9 more tortuous and meander, and can make the refrigerant stay in the flow channel 9 for a longer time, so that the refrigerant can be mixed more uniformly.

The distributor 3 includes a first portion 15 and a second portion 16. The main cavity 6 is disposed at the first portion 15. The second portion 16 is closer to the first inner peripheral wall 11 than the first portion 15.

A portion of the flow channel 9 is located between the first portion 15 and the second portion 16. The first portion 15 has a first wall surface 21. The second portion 16 has a second wall surface 22. Both the first wall surface 21 and the second wall surface 22 are part of a wall surface of the distributor 3 forming the flow channel 9.

The first portion 15 has a plurality of first recessed portions 23. The first recessed portions 23 are formed on the first wall surface 21. Openings of the first recessed portions 23 face the second portion 16. The second portion 16 has a plurality of second recessed portions 24. The second recessed portions 24 are formed on the second wall surface 22. Openings of the plurality of second recessed portions 24 face the first portion 15. Each of the first recessed portions 23 is opposite to each of the second recessed portions 24. A first convex portion 190 is formed between every two adjacent first recessed portions 23. A second convex portion 191 is formed between every two adjacent second recessed portions 24. A minimum distance between the first convex portion 190 and the second convex portion 191 is 0.2 mm to 5 mm. A minimum distance between a lowest point of each first recessed portion 23 and a lowest point of each second recessed portion 24 is 1.2 to 5 times the minimum distance between the first convex portion 190 and the second convex portion 191 at this time. Under the action of the first recessed portions 23 and the second recessed portions 24, the flow channel can achieve the effect of sudden expansion and sudden contraction, so that the gas-liquid two-phase refrigerant can be mixed more uniformly. This is beneficial to make the gas-liquid two-phase refrigerant more evenly distributed in the heat exchange tube 2, thereby improving the heat exchange effect.

On a cross section of the distributor 3, a concave surface of the first recessed portion 23 is of a first circular arc shape, and a concave surface of the second recessed portion 24 is of a second circular arc shape. The first circular arc shape and the second circular arc shape belong to different parts on a same circle. When manufacturing the first recessed portions 23 and the second recessed portions 24, a cylindrical mold can be inserted into the flow channel 9, so that the first recessed portions 23 and the second recessed portions 24 can be simultaneously processed by the mold, thereby reducing the processing steps.

The first peripheral wall 12 of the distributor 3 has a plurality of ridge portions 50 and a plurality of flat portions 51. The flat portion 51 is substantially flat. The plurality of ridge portions 50 are arranged in a width direction of the distributor 3. Each ridge portion 50 is located between two adjacent flat portions 51. A gap is formed between the flat portion 51 and the heat exchange tube 2. The ridge portion 50 protrudes from the flat portion 51 toward the heat exchange tube 2. A top of the ridge portion 50 away from the flat portion 51 is in contact with or adjacent to the heat exchange tube 2. When the heat exchanger 100 is tilted to various angles for use, because the ridge portions 50 can hinder or slow down the flow of the refrigerant along the first peripheral wall 12 of the distributor 3 under the influence of gravity, the refrigerant can flow into the heat exchange tubes 2 which are in contact with or adjacent to the ridge portions 50 even in the inclined state, which ensures the uniform distribution of the refrigerant in the heat exchange tubes 2. The second port 8 is located on the flat portion 51. Providing the second port 8 on the flat portion 51 can facilitate the processing of the second port 8.

The flow channel 9 includes an interlayer cavity 60, a first passage 63 and a second passage 102. The interlayer cavity 60 is located between the first portion 15 and the second portion 16.

Figure 15:
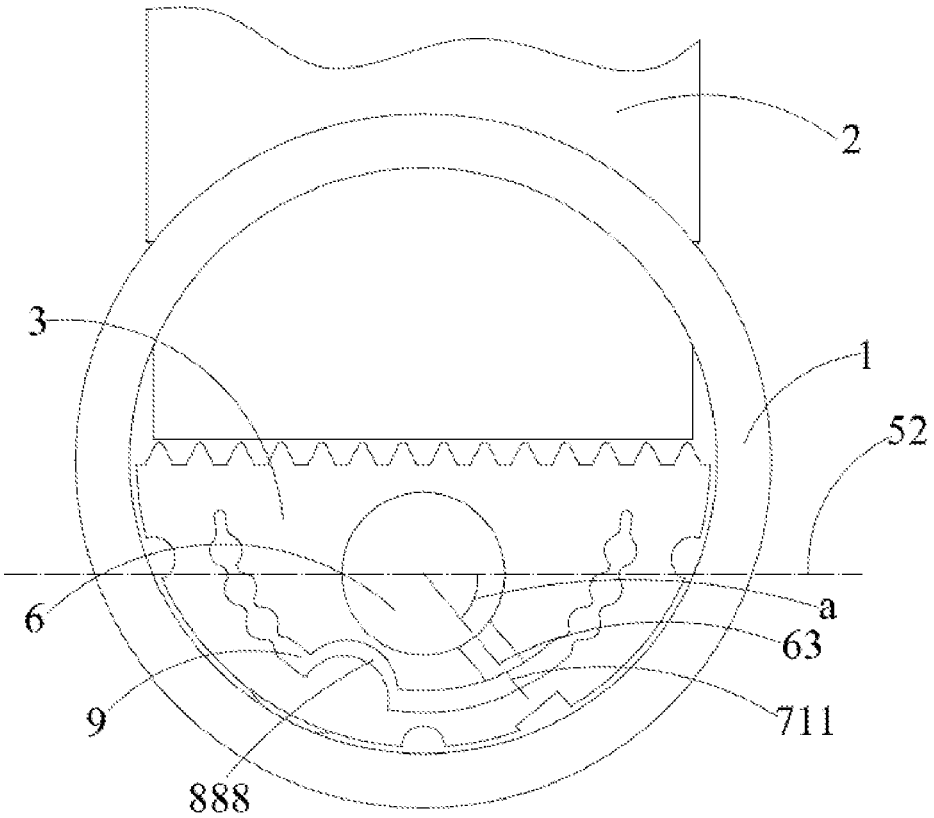
FIG. 15 is a schematic structural view of the distributor in another embodiment of the present disclosure.
Figure 16:
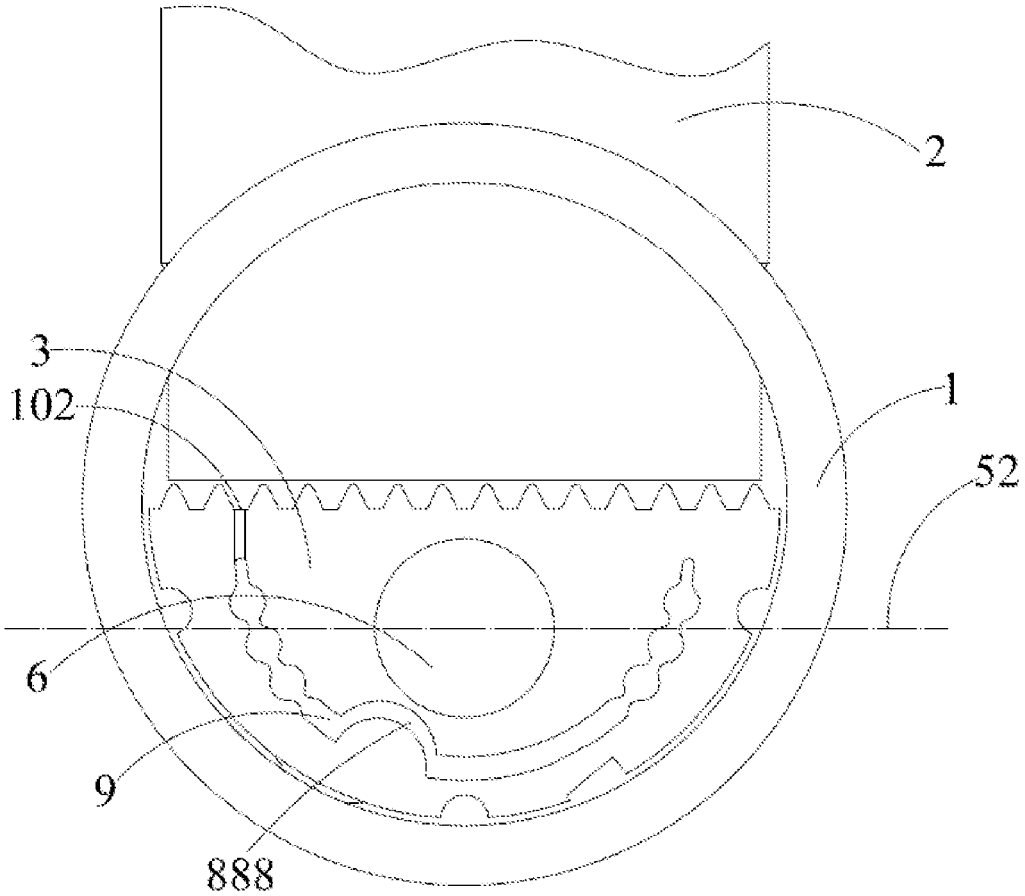
FIG. 16 is a schematic structural view of the distributor in another embodiment of the present disclosure.

As shown in FIG. 15 and FIG. 16, in another embodiment, the flow channel 9 includes a buffer cavity 888. In a direction around the main cavity 6, the buffer cavity 888 is located between the first passage 63 and the second passage 102. The buffer cavity 888 is closer to the main cavity 6 than remain part of the flow channel 9, or the buffer cavity 888 is far away from the main cavity 6 than remain part of the flow channel 9. The setting of the buffer cavity 888 can make the refrigerant stay in the flow channel 9 for a longer time, so that the gas-liquid two-phase refrigerant can be mixed more uniformly. According to an embodiment of the present disclosure, the buffer cavity 888 is of an arc shape, and a middle of the arc shape extends from the flow channel 9 towards the main cavity 6.

Figure 6:
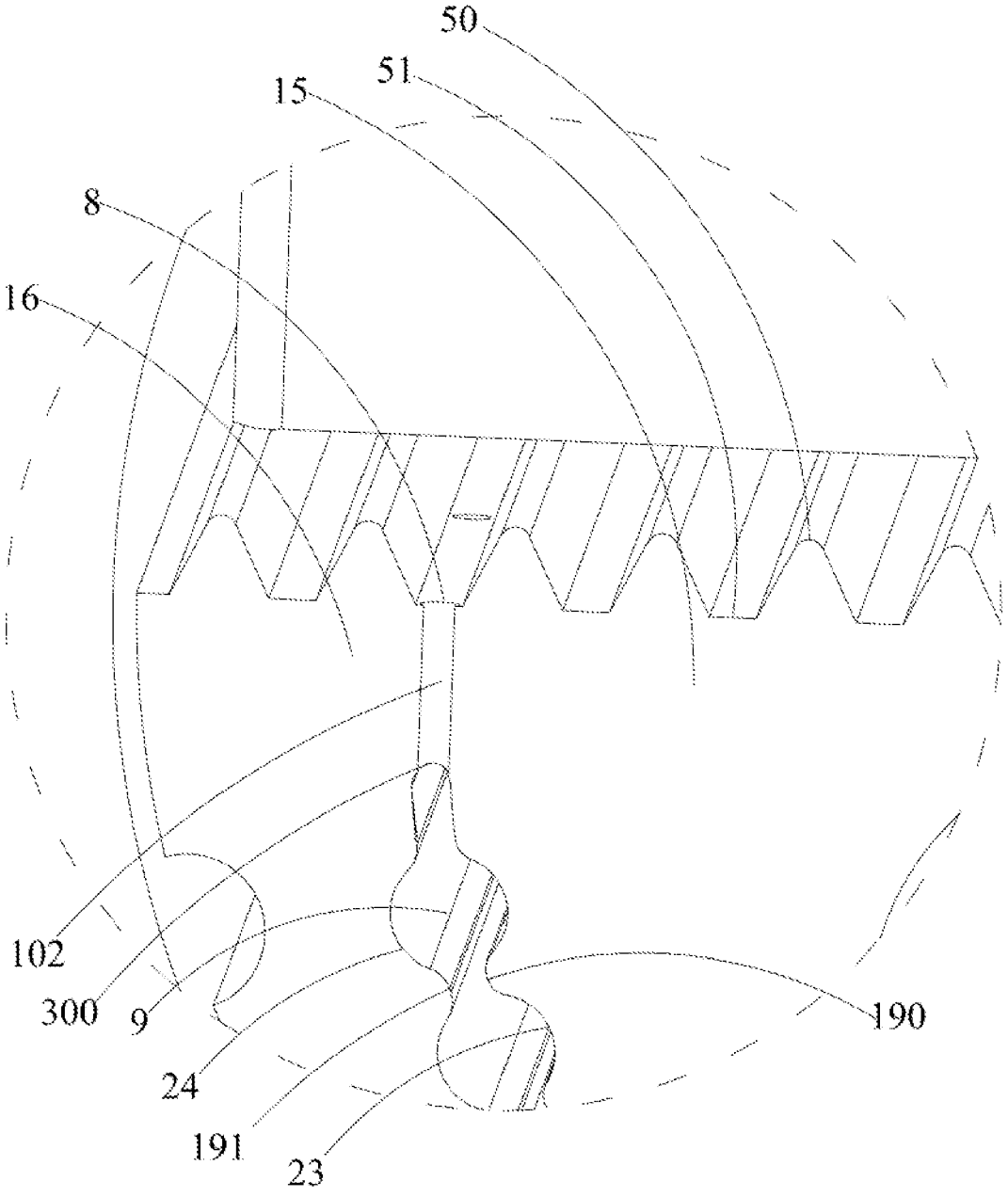
FIG. 6 is an enlarged view at portion C in FIG. 5.
Figure 9:
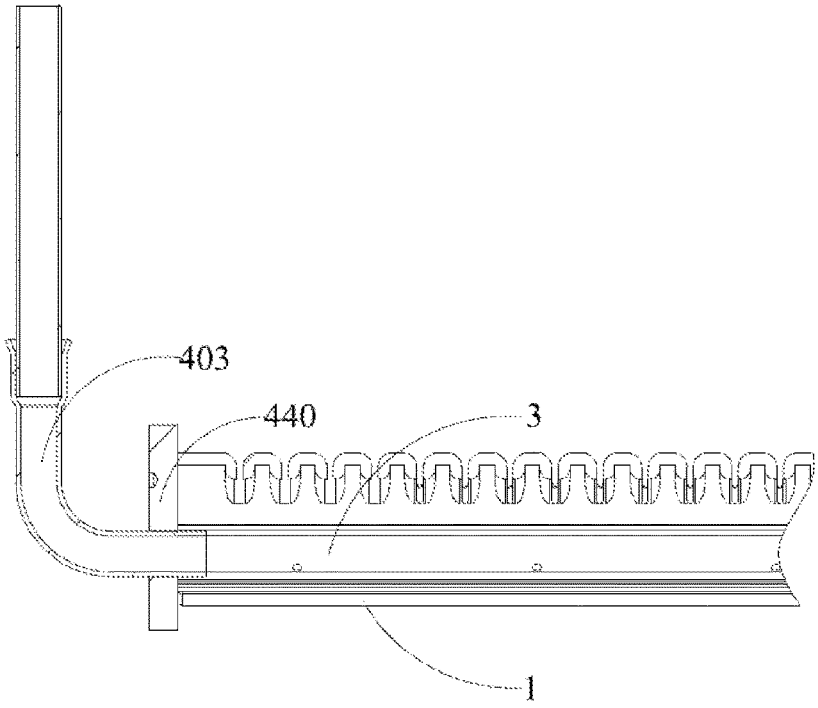
FIG. 9 is a schematic cross-sectional structural view of an inlet pipe, an end cap and a distributor in accordance with an embodiment of the present disclosure.
Figure 10:
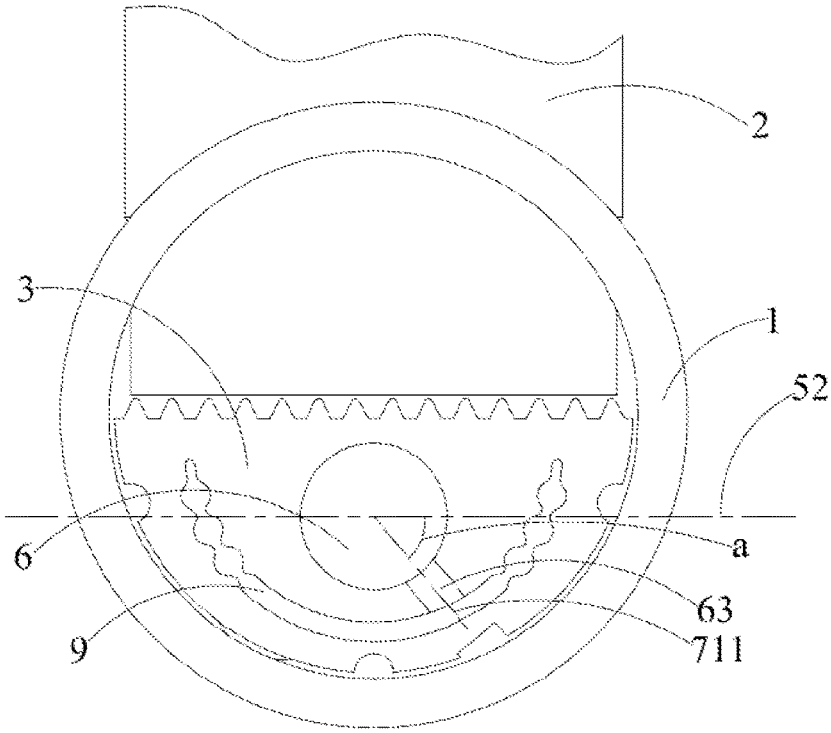
FIG. 10 is another schematic cross-sectional view of the distributor and the collecting pipe in accordance with the embodiment of the present disclosure.
Figure 11:
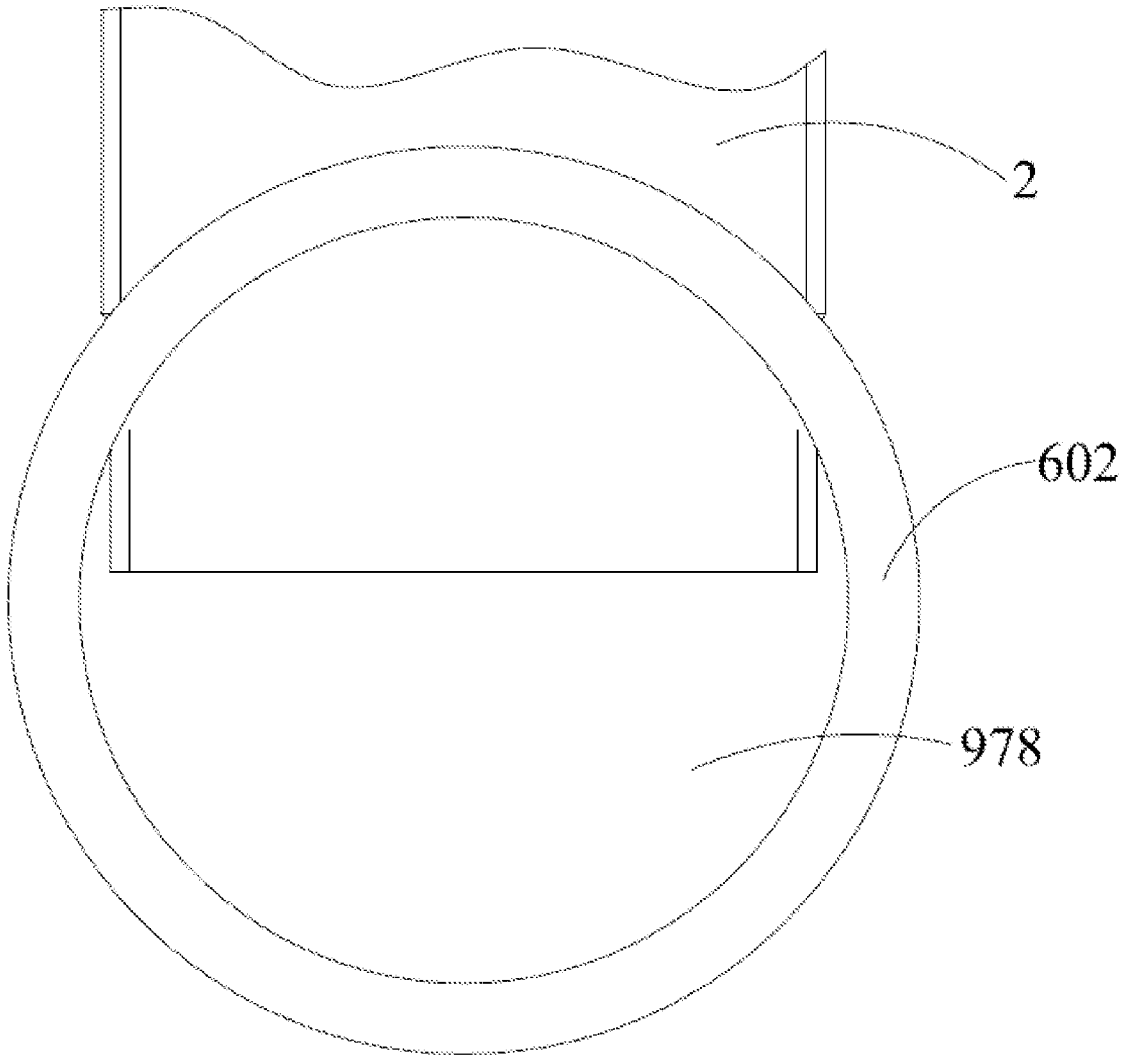
FIG. 11 is a schematic cross-sectional structural view of a second collecting pipe and a heat exchange tube in accordance with an embodiment of the present disclosure.
Figure 12:
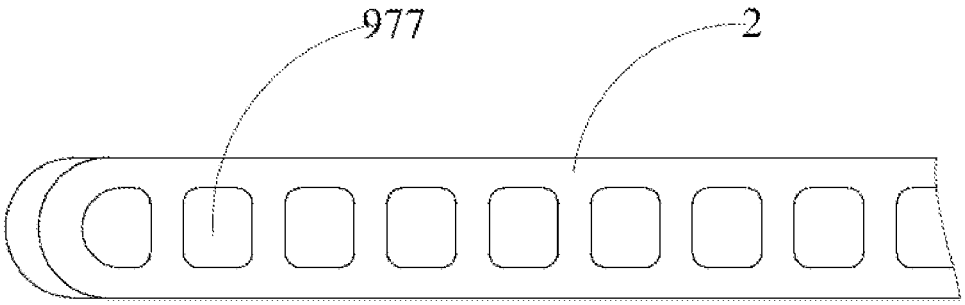
FIG. 12 is a schematic cross-sectional structural view of the heat exchange tube in accordance with the embodiment of the present disclosure.

As shown in FIG. 6, FIG. 7 and FIG. 9, a plane passing through an axis of the main cavity 6 and parallel to the flat portions 51 is defined as a first reference plane 52, the first port 7 is located on a side of the first reference plane 52 away from the flat portions 51, and the second port 8 is located on another side of the first reference plane 52 adjacent to the flat portion 51. By letting the refrigerant enter the flow channel 9 from the first port 7 below the main cavity 6, and then flow out from the second port 8 located above through the flow channel 9, the refrigerant can stay in the flow channel 9 for a longer time, so that the gas-liquid two-phase refrigerant is mixed more uniformly.

Referring to FIG. 7, the distributor 3 further includes two connecting portions 101 which are located on two sides of the first portion 15 in a width direction of the distributor 3, respectively. The connecting portions 101 are connected between the first portion 15 and the second portion 16 in the width direction of the distributor 3. One of the connecting portions 101 has a first side surface 61, and a remaining one of the connecting portions 101 has a second side surface 62. Both the first side surface 61 and the second side surface 62 are part of a wall surface forming the flow channel 9.

A plane passing through the axis of the first passage 63 and parallel to the length direction of the distributor 3 is defined as a second reference plane 711. An angle between the first reference plane 52 and the second reference plane 711 is defined as $\alpha$, where $\alpha$ is between 0 degrees and minus 180 degrees. By setting $\alpha$ between 0 degrees and minus 180 degrees, the refrigerant can flow into the flow channel 9 from a position below the second reference plane 711. As a result, the refrigerant can stay in the flow channel 9 for a longer time, so that the gas-liquid two-phase refrigerant can be mixed more uniformly.

The first passage 63 includes a first port 7 and a third port 64. The third port 64 is located on the first wall surface 21, and the third port 64 communicates with the interlayer cavity 60. The first port 7 and the third port 64 are located on two sides of the first passage 63 in the axial direction, respectively. In the direction around the main cavity 6, the third port 64 is located between the first side surface 61 and the second side surface 62. By arranging the third port 64 between the first side surface 61 and the second side surface 62, the third port 64 and the first side surface 61 can be spaced apart, and the third port 64 and the second side surface 62 can also be spaced apart. This arrangement can make the flow channel 9 and the third port 64 do not need high alignment accuracy in the process of manufacturing, so that the third port 64 and the flow channel can be aligned. Therefore, during manufacturing, the third port 64 and the flow channel 9 are not arranged in a staggered manner, so that the flow rate of the refrigerant flowing into the flow channel 9 from the third port 64 is not reduced significantly.

Along the length direction of the heat exchange tube 2, the connecting portion 101 is closer to the heat exchange tube 2 than the interlayer cavity 60. The second passage 102 is disposed in one of the two connecting portions 101, and a plurality of the second passages 102 are arranged along the length direction of the distributor 3. Each second passage 102 includes a second port 8 and a fourth port 300. The second port 8 and the fourth port 300 are located on two sides of the second passage 102 in the axial direction, respectively. The fourth port 300 is located on the first side surface 61 or the second side surface 62. The fourth port 300 communicates with the interlayer cavity 60. The plurality of second passages 102 are arranged along a length of the distributor 3 to allow the refrigerant to be ejected from the plurality of second passages 102. Then, the refrigerant is sprayed to the plurality of heat exchange tubes 2 which are also arranged along the length direction of the first collecting pipe 601, so that the amount of the refrigerant entering each heat exchange tube 2 is relatively more uniform.

In the direction around the main cavity 6, the first recessed portion 23 and the second recessed portion 24 are both closer to the fourth port 300 than the third port 64. By arranging the first recessed portion 23 and the second recessed portion 24 closer to the fourth port 300, it can be avoided that the pressure is lowered too much while the fluid is flowing, so as not to affect the heat exchange.

The distributor 3 is welded with the first inner peripheral wall 11. By welding the distributor 3 and the first inner peripheral wall 11 as a whole, influence to the distribution of the refrigerant caused by the positional deviation of the distributor 3 in the first collecting pipe during use can be reduced.

The distributor 3 can be used not only for the cylindrical collecting pipe in this embodiment, but also for cuboid or semi-cylindrical collecting pipes.

Figure 17:
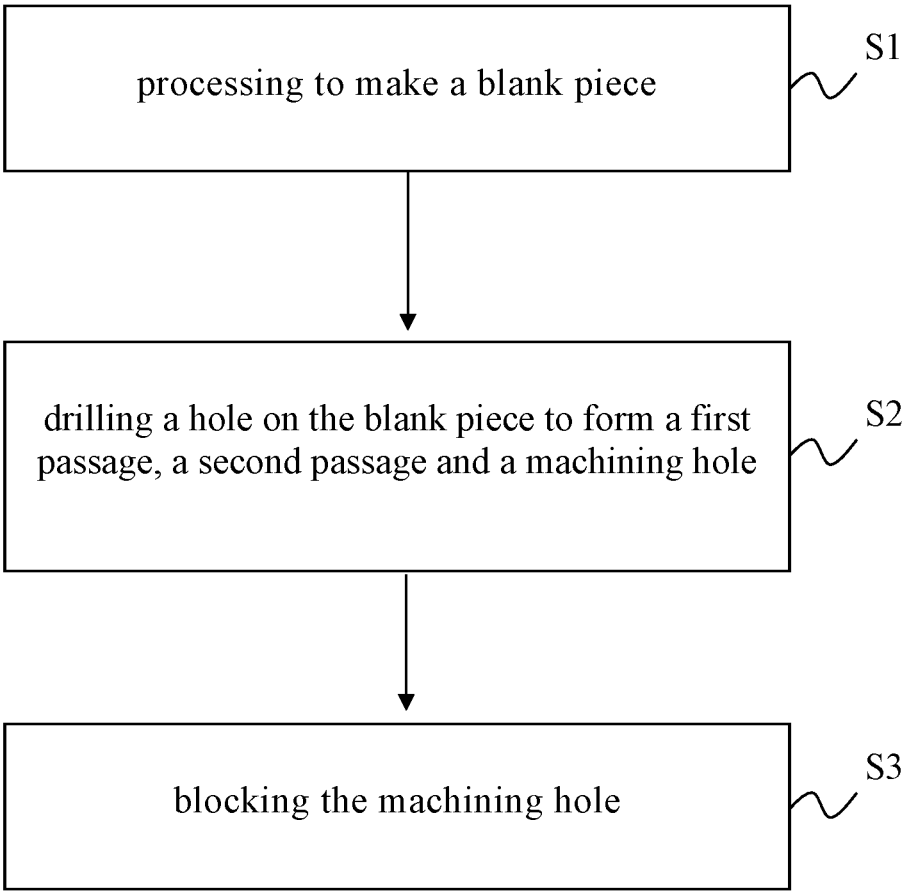
FIG. 17 is a flowchart of a method for manufacturing the distributor in accordance with an embodiment of the present disclosure.

As shown in FIG. 17, a processing method of the distributor includes the following steps:

step S1: processing to make a blank piece 600;

step S2: drilling a hole on the blank piece 600 to form the first passage 63, the second passage 102 and a machining hole; and step S3: blocking the machining hole.

Figure 18:
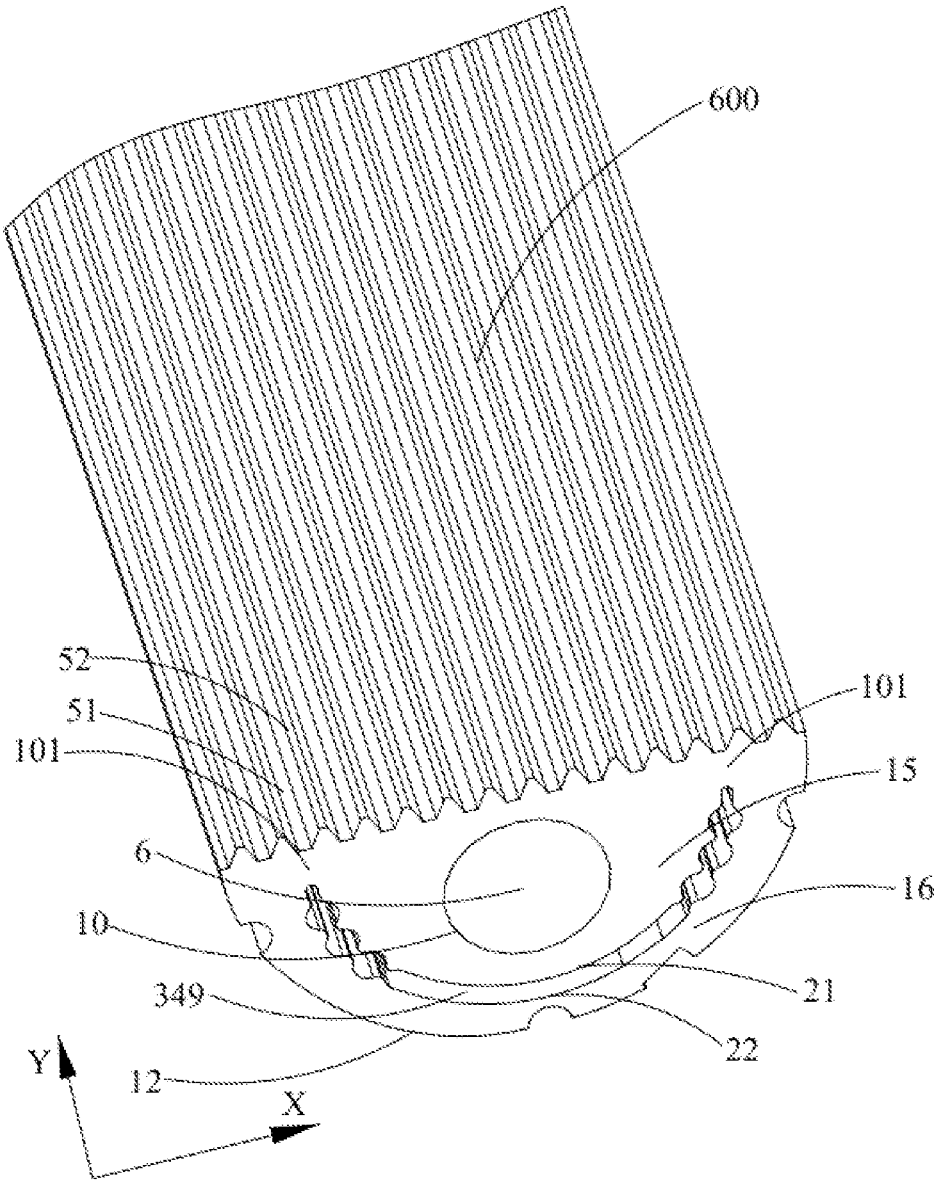
FIG. 18 is a schematic structural view of a blank piece according to an embodiment of the present disclosure.

In the step S1, the blank piece 600 having the main cavity 6 and a matting cavity 349 can be processed by extrusion molding. As shown in FIG. 18, the blank piece 600 includes the second inner peripheral wall 10, the first outer peripheral wall 12, the first portion 15, the second portion 16 and the connecting portion 101, where the connecting portion 101 connects the first portion 15 and the second portion 16, the second inner peripheral wall 10 located at the periphery of the main cavity 6, and the second inner peripheral wall 10 forming the main cavity 6. The mating cavity 349 is located at least partially between the first portion 15 and the second portion 16. The first portion 15 has the first wall surface 21. The second portion 16 has the second wall surface 22. The first wall surface 21 faces the second portion 16. The second wall surface 22 faces the first portion 15. Both the first wall surface 21 and the second wall surface 22 are part of the wall surface of the blank piece 600 forming the mating cavity 349. The main cavity 6 is not communicated with the mating cavity 349.

As shown in FIG. 18, the blank piece 600 also has a plurality of ridge portions 50 and a plurality of flat portions 51. The plurality of ridge portions 50 and the plurality of flat portions 51 are connected with each other. The plurality of ridge portions 50 and the plurality of flat portions 51 are located at the first outer peripheral wall 12. The plurality of flat portions 51 are perpendicular to a thickness direction Y of the blank piece 600, and the plurality of the flat portions 51 are aligned along a width direction X of the blank piece 600. The thickness direction Y of the blank piece 600 is parallel to a thickness direction of the distributor 3, and the width direction X of the blank piece 600 is parallel to the width direction of the distributor 3. When the distributor 3 is assembled with the first collecting pipe 601, the second collecting pipe 602 and the heat exchange tube 2, the thickness direction of the distributor 3 is parallel to the length direction of the heat exchange tube 2, and the width direction of the distributor 3 is parallel to a width direction of the collecting pipe.

In the step S2, the blank piece 600 are drilled to form the first passage 63 and the second passage 102. The step S2 includes the following steps:

step S21: drilling a first hole on the blank piece 600, where the first hole includes the first passage 63 and the machining hole, the first passage 63 extending through the first portion 15, and the machining hole extending through the second portion 16; and step S22: drilling a second hole on the blank piece 600, where the second hole includes the second passage 102, the second passage 102 extending through the connecting portion 101.

In the step S21, the first hole is drilled at the first outer peripheral wall 12, so that the first hole passes through the first outer peripheral wall 12, the mating cavity 349 and the second inner peripheral wall 10 in sequence. In a drilling direction, the extension of the first hole forms the first passage 63 between the second inner peripheral wall 10 and the first wall surface 21, and the machining hole between the first outer peripheral wall 12 and the second wall surface 22. The first passage 63 includes the first port 7 and the third port 64. The first passage 63 communicates the main cavity 6 and the matting cavity 349. The machining hole communicates the matting cavity 349 and outside of the blank piece 600. According to an embodiment of the present disclosure, an axis of the first passage 63 and an axis of the machining hole are coaxial with each other.

In the step 22, the second passage 102 includes the second port 8 and the fourth port 300. The second passage 102 communicates the matting cavity 349 and outside of the blank piece 600.

The mating cavity 349 is formed with the second port 8 at the first peripheral wall 12 and the first port 7 at the second inner peripheral wall 10 by the step S2. And the flow channel 9 is formed by the mating cavity 349. The first port 7 communicates with the main cavity 6. The second port 8 communicates with the first cavity 4. The smallest circle surrounding the first port 7 is defined as a first outer circle W1. The smallest circle surrounding the second port 8 is defined as a second outer circle W2. The axis of the first outer circle W1 and the axis of the second outer circle W2 are not coaxial.

In the step S3, the machining hole is blocked, for example, by a film. After the step S21, the machining hole having a fifth port at the first peripheral wall 12 is formed.

The machining hole needs to be blocked to avoid the refrigerant to leak therethrough during the use of distributor 3. According to an embodiment of the present disclosure, a film, such as an aluminum film, can be used to cover the fifth port, to block the machining hole. For example, the aluminum film is in sealing connection with the first peripheral wall 12, and the projection of the fifth port of the machining hole is in a range of an outline of the aluminum film along an axial direction of the machining hole.

After the step S3, the flow channel 9 is formed by the mating cavity 349 and the first passage 63. Blocking the machining hole can reduce the inability to mix the gas-liquid two-phase refrigerant through the flow channel 9 because the refrigerant flows out of the machining hole during the use of the distributor 3.

The above embodiments are only used to illustrate the present disclosure and not to limit the technical solutions described in the present disclosure. The understanding of this specification should be based on those skilled in the art. Descriptions of directions, although they have been described in detail in the above-mentioned embodiments of the present disclosure, those skilled in the art should understand that modifications or equivalent substitutions can still be made to the application, and all technical solutions and improvements that do not depart from the spirit and scope of the application should be covered by the claims of the application.

What is claimed is:

1. A heat exchanger, comprising:

a collecting pipe having a first cavity and a first inner peripheral wall forming the first cavity;

a plurality of heat exchange tubes disposed along a length direction of the collecting pipe, each heat exchange tube having a second cavity communicating with the first cavity; and a distributor at least partially located in the first cavity, the distributor having a main cavity and a flow channel, the distributor comprising a second inner peripheral wall forming the main cavity and a first outer peripheral wall facing the first inner peripheral wall;

wherein the flow channel is formed with a first port at the second inner peripheral wall and a second port at the first outer peripheral wall, the first port communicates with the main cavity, the second port communicates with the first cavity, a smallest circle around the first port is defined as a first outer circle, a smallest circle around the second port is defined as a second outer circle, and an axis of the first outer circle is not coaxial with an axis of the second outer circle;

wherein the distributor comprises a first portion and a second portion, the main cavity is arranged at the first portion, the second portion is closer to the first inner peripheral wall than the first portion;

wherein a portion of the flow channel is located between the first portion and the second portion, the first portion has a first wall surface, the second portion has a second wall surface, both the first wall surface and the second wall surface are part of a wall surface of the distributor forming the flow channel; and wherein the first portion has a plurality of first recessed portions formed on the first wall surface, openings of the plurality of first recessed portions face the second portion; the second portion has a plurality of second recessed portions formed on the second wall surface, and openings of the plurality of the second recessed portions face the first portion.

2. The heat exchanger according to claim 1, wherein the first outer peripheral wall of the distributor has a plurality of ridge portions and a plurality of flat portions, the plurality of the ridge portions are disposed along a width direction of the distributor, each ridge portion is located between two adjacent flat portions, a gap is formed between the flat portion and the heat exchange tube, the ridge portion protrudes beyond the flat portion toward the heat exchange tube, a top end of the ridge portion away from the flat portion is in contact with or adjacent to the heat exchange tube, and the second port is located on the flat portion.

3. The heat exchanger according to claim 2, wherein a plane passing through an axis of the main cavity and parallel to the flat portion is defined as a first reference plane, the first port is located on a side of the first reference plane away from the flat portion, and the second port is located on another side of the first reference plane adjacent to the flat portion.

4. The heat exchanger according to claim 1, wherein the distributor further comprises two connecting portions located on two sides of the first portion in a width direction of the distributor, respectively; each connecting portion is located between the first portion and the second portion in the width direction of the distributor, and each connecting portion is connected to the first portion and the second portion; and one of the connecting portions has a first side surface, a remaining one of connecting portions has a second side surface, and both the first side surface and the second side surface are part of the wall surface forming the flow channel.

5. The heat exchanger according to claim 4, wherein the flow channel further comprises an interlayer cavity, a first passage and a second passage;

the interlayer cavity is located between the first portion and the second portion;

the first passage comprises the first port and a third port, the third port is located on the first wall surface, the third port communicates with the interlayer cavity, the first port and the third port are located on two sides of the first passage in an axial direction of the first passage, respectively; in a direction around the main cavity, the third port is located between the first side surface and the second side surface;

the connecting portion is closer to the heat exchange tube than the interlayer cavity, the plurality of second passages are arranged in one of the two connecting portions, the second passages comprises the second port and a fourth port, the second port and the fourth port are located on two sides of the second passage in an axial direction of the second passage, respectively; the fourth port is located on the first side surface or the second side surface, and the fourth port communicates with the interlayer cavity.

6. The heat exchanger according to claim 5, wherein in the direction around the main cavity, the first recessed portions and the second recessed portions are closer to the fourth port than the third port; and on a cross section of the distributor, a concave surface of the first recessed portion is of a first circular arc shape, a concave surface of the second recessed portion is of a second circular arc shape, and the first circular arc shape and the second circular arc shape belong to different parts on a same circle.

7. The heat exchanger according to claim 1, wherein the first outer peripheral wall of the distributor is welded with the first inner peripheral wall.

8. A heat exchanger, comprising:

a collecting pipe having a first cavity and a first inner peripheral wall forming the first cavity;

a plurality of heat exchange tubes disposed along a length direction of the collecting pipe, each heat exchange tube having a second cavity communicating with the first cavity; and a distributor at least partially located in the first cavity, the distributor having a main cavity and a flow channel, the distributor comprising a second inner peripheral wall forming the main cavity and a first outer peripheral wall facing the first inner peripheral wall;

wherein the flow channel is formed with a first port at the second inner peripheral wall and a second port at the first outer peripheral wall, the first port communicates with the main cavity, the second port communicates with the first cavity, a smallest circle around the first port is defined as a first outer circle, a smallest circle around the second port is defined as a second outer circle, and an axis of the first outer circle is not coaxial with an axis of the second outer circle;

wherein the flow channel further comprises a first passage, a second passage and a buffer cavity; in a direction around the main cavity, the buffer cavity is located between the first passage and the second passage, the buffer cavity is of an arc shape, and a middle portion of the arc shape extends from the flow channel toward the main cavity.

9. The heat exchanger according to claim 3, wherein the flow channel further comprises a first passage, a plane passing through an axis of the first passage and parallel to a length direction of the distributor is defined as a second reference plane, an angle between the first reference plane and the second reference plane is defined as $\alpha$, where $\alpha$ is between 0 degrees and minus 180 degrees.

10. A heat exchanger, comprising:

a collecting pipe defining a first cavity extending along a horizontal direction;

a plurality of heat exchange tubes extending along a vertical direction perpendicular to the horizontal direction, each heat exchange tube defining a row of second cavities arranged along a transverse direction perpendicular to the vertical direction, each second cavity communicating with the first cavity, the heat exchange tubes being retained to the collecting pipe; and a distributor disposed in the first cavity, the distributor defining a main cavity extending along the horizontal direction and a flow channel communicating with the main cavity and the first cavity, the distributor comprising a first end wall facing the heat exchange tubes;

wherein the distributor comprises a first portion with a first wall surface and a second portion with a second wall surface, the flow channel being an internal channel, the flow channel comprising a first section going through the first wall surface, a second section disposed between the first wall surface and the second wall surface, and a third section going through the first end wall;

wherein the first portion has a plurality of first recessed portions formed on the first wall surface, openings of the plurality of first recessed portions facing the second portion;

wherein the second portion has a plurality of second recessed portions formed on the second wall surface, openings of the plurality of the second recessed portions facing the first portion.

11. The heat exchanger according to claim 10, wherein an axial direction of the first section is disposed obliquely to an axial direction of the third section.

12. The heat exchanger according to claim 10, wherein the axial direction of the third section is perpendicular to the transverse direction, and the axial direction of the first section is disposed at an oblique angle relative to the transverse direction.

13. The heat exchanger according to claim 10, wherein the main cavity is of a circular hole, the second section of the flow channel surrounding around the main cavity along a circumferential direction of the main cavity.

14. The heat exchanger according to claim 8, wherein the distributor comprises a first portion and a second portion, the main cavity is arranged at the first portion, the second portion is closer to the first inner peripheral wall than the first portion;

wherein a portion of the flow channel is located between the first portion and the second portion, the first portion has a first wall surface, the second portion has a second wall surface, both the first wall surface and the second wall surface are part of a wall surface of the distributor forming the flow channel; and wherein the first portion has a plurality of first recessed portions formed on the first wall surface, openings of the plurality of first recessed portions face the second portion; the second portion has a plurality of second recessed portions formed on the second wall surface, and openings of the plurality of the second recessed portions face the first portion.

15. The heat exchanger according to claim 8, wherein the first outer peripheral wall of the distributor has a plurality of ridge portions and a plurality of flat portions, the plurality of the ridge portions are disposed along a width direction of the distributor, each ridge portion is located between two adjacent flat portions, a gap is formed between the flat portion and the heat exchange tube, the ridge portion protrudes beyond the flat portion toward the heat exchange tube, a top end of the ridge portion away from the flat portion is in contact with or adjacent to the heat exchange tube, and the second port is located on the flat portion.

16. The heat exchanger according to claim 15, wherein a plane passing through an axis of the main cavity and parallel to the flat portion is defined as a first reference plane, the first port is located on a side of the first reference plane away from the flat portion, and the second port is located on another side of the first reference plane adjacent to the flat portion.

17. The heat exchanger according to claim 14, wherein the distributor further comprises two connecting portions located on two sides of the first portion in a width direction of the distributor, respectively; each connecting portion is located between the first portion and the second portion in the width direction of the distributor, and each connecting portion is connected to the first portion and the second portion; and one of the connecting portions has a first side surface, a remaining one of connecting portions has a second side surface, and both the first side surface and the second side surface are part of the wall surface forming the flow channel.

18. The heat exchanger according to claim 17, wherein the flow channel further comprises an interlayer cavity, a first passage and a second passage;

the interlayer cavity is located between the first portion and the second portion;

the first passage comprises the first port and a third port, the third port is located on the first wall surface, the third port communicates with the interlayer cavity, the first port and the third port are located on two sides of the first passage in an axial direction of the first passage, respectively; in a direction around the main cavity, the third port is located between the first side surface and the second side surface;

the connecting portion is closer to the heat exchange tube than the interlayer cavity, the plurality of second passages are arranged in one of the two connecting portions, the second passages comprises the second port and a fourth port, the second port and the fourth port are located on two sides of the second passage in an axial direction of the second passage, respectively; the fourth port is located on the first side surface or the second side surface, and the fourth port communicates with the interlayer cavity.

19. The heat exchanger according to claim 18, wherein in the direction around the main cavity, the first recessed portions and the second recessed portions are closer to the fourth port than the third port; and on a cross section of the distributor, a concave surface of the first recessed portion is of a first circular arc shape, a concave surface of the second recessed portion is of a second circular arc shape, and the first circular arc shape and the second circular arc shape belong to different parts on a same circle.

20. The heat exchanger according to claim 16, wherein the flow channel further comprises a first passage, a plane passing through an axis of the first passage and parallel to a length direction of the distributor is defined as a second reference plane, an angle between the first reference plane and the second reference plane is defined as $\alpha$, where $\alpha$ is between 0 degrees and minus 180 degrees.

* * * * *